US007240714B2

(12) United States Patent
Drew et al.

(10) Patent No.: US 7,240,714 B2
(45) Date of Patent: Jul. 10, 2007

(54) SYSTEM FOR SUSPENDING A FREE-HANGING COVERING FOR AN ARCHITECTURAL OPENING

(75) Inventors: Terrence M. Drew, Superior, CO (US); Stephen P. Smith, Denver, CO (US); James L. Miller, Henderson, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 64 days.

(21) Appl. No.: 11/219,413

(22) Filed: Sep. 2, 2005

(65) Prior Publication Data

US 2006/0048903 A1 Mar. 9, 2006

Related U.S. Application Data

(60) Provisional application No. 60/608,285, filed on Sep. 8, 2004.

(51) Int. Cl.
*E06B 5/00* (2006.01)

(52) U.S. Cl. ..... 160/84.04; 248/316.1; 248/316.7; 248/316.8

(58) Field of Classification Search ..... 160/84.07, 160/84.05, 84.04, 134, 115, 902; 248/316.1, 248/262, 316.7, 316.8, 231.71, 231.81, 251, 248/267, 273, 254, 269

See application file for complete search history.

(56) References Cited

U.S. PATENT DOCUMENTS

| | | | | |
|---|---|---|---|---|
| 4,518,025 | A * | 5/1985 | Judkins | 160/84.04 |
| 5,320,154 | A * | 6/1994 | Colson et al. | 160/121.1 |
| 5,419,385 | A * | 5/1995 | Vogel et al. | 160/121.1 |
| 6,899,156 | B2 * | 5/2005 | Tyner | 160/178.1 R |
| 7,134,469 | B2 * | 11/2006 | Drew et al. | 160/38 |

* cited by examiner

*Primary Examiner*—Hugh B. Thompson, II
*Assistant Examiner*—Candace L. Bradford
(74) *Attorney, Agent, or Firm*—Dorsey & Whitney LLP

(57) ABSTRACT

A system for suspending a free-hanging shade material in an architectural opening includes a panel of shade material and brackets that can be mounted to the top edge of the framework around the architectural opening even when the top edge is not straight or horizontally disposed. The top edge of the panel has reinforcement strips operatively connected thereto which are releasably connected to the brackets. The system is useful in conventional rectangular architectural openings or openings of unusual shapes and sizes such as semi-circular or having an inclined top edge.

7 Claims, 11 Drawing Sheets

SYSTEM FOR SUSPENDING A FREE-HANGING COVERING FOR AN ARCHITECTURAL OPENING

CROSS-REFERENCE TO RELATED APPLICATION

This application claims the benefit of U.S. provisional application No. 60/608,285 filed Sep. 8, 2004, which application is hereby incorporated by reference as if fully disclosed herein.

BACKGROUND OF THE INVENTION

1. Field of the Invention

The present invention relates generally to free-hanging coverings for architectural openings and more particularly to a system for suspending a free-hanging covering in an architectural opening which may be non-rectangular in configuration.

2. Description of the Relevant Art

Coverings for architectural openings such as doors, windows, archways and the like have taken numerous forms for many years with early coverings simply consisting of fabric draped across an architectural opening. Through the years, however, more sophisticated and even designer-type coverings have been made which are retractable in nature. By way of example, a venetian blind is a very common retractable covering for an architectural opening wherein a plurality of horizontally disposed slats are supported on tape or cord ladders so the slats can be tilted about their horizontal longitudinal axes or gathered into a stack at the top of the architectural opening in a retracted position of the covering.

Vertical blinds are also available which are similar to venetian blinds except the slats are extended vertically, but again will pivot about their longitudinal axes or can be gathered into a compact stack adjacent one or both sides of the architectural opening.

Cellular shades have become very popular wherein collapsible cells of a fabric material are horizontally extended across an opening and can be retracted adjacent one edge of the opening with lift cords that move one edge of the covering toward an opposite edge while successively collapsing cells until there is a compact stack of the cells adjacent the opposite edge of the opening.

More recently, a cellular shade has been developed which includes a pair of spaced fabric sheets of material such as sheer that are interconnected at spaced locations with horizontal vanes that may or may not be flexible. When one sheet of material is shifted relative to the other, the vanes are moved or pivoted between open and closed positions such that when the vanes are in a closed position, they overlap and lie in a parallel plane with the sheets of material but in an open position bridge a space between the sheets of material and define gaps therebetween through which light and vision can pass. Typically coverings of this type are rolled around a roller at the top or bottom of the architectural opening to retract the covering.

There are many times, however, when retractable shades are not necessary or desirable such as with accent windows that might be positioned above larger picture windows or along the crowned upper edge of a door or a relatively small wall in an architectural structure. In such accent windows it is many times desirable that the covering simply be fully extended across the opening at all times. A problem in dealing with accent windows is that they are not always rectangular in configuration and some may for example have a curved or arched top edge or an inclined top edge so they are not easily covered with conventional covering materials.

It is to provide a free-hanging covering for architectural openings which finds a particular but not exclusive use in openings of unusual configuration that the present invention has been developed.

BRIEF SUMMARY OF THE INVENTION

The system of the present invention is adapted to suspend a shade material across an architectural opening by suspending the material from an upper edge that may be cut or contoured to fit the upper edge of the framework around an architectural opening. By suspending a sufficient length of the shade material along the upper edge thereof and if necessary anchoring the lower edge to the sill of the architectural opening or to a weighted rail, the shade material will remain extended across the full cross-section of the architectural opening.

The upper edge of the shade material is provided with at least one reinforcement strip which rigidifies the edge of the shade material and the reinforcement strip is adapted to operatively cooperate with support brackets that are anchorable to the framework of the architectural opening along an upper edge thereof. The support brackets have a downwardly opening channel with a lip that projects into the channel and wherein the lip is adapted to cooperate with the reinforcement strip to hold the reinforcement strip along with the upper edge of the shade material in the channel so that the upper edge of the shade material is suspended from the support bracket within the architectural opening. A plurality of the support brackets may be placed along the framework of the architectural opening as may be needed.

In one embodiment of the invention, a support channel is positioned along the upper edge of the shade material with the channel having upstanding side walls adapted to be received in a pair of downwardly opening channels of the support brackets. The shade material is secured to the side walls of the support channel so that the support channel, which becomes operatively connected to the reinforcement strips, is also suspended from the support brackets along with the shade material.

The system of the present invention is applicable to many varieties of shade material including but not limited to those wherein a pair of vertically extending sheets of material are separated by a plurality of parallel vanes so that the shade material is suspended in a free-hanging condition across the architectural opening. In this condition, the shade material resembles a retractable shade in a fully-extended position that may have the vanes open to define gaps therebetween.

Other aspects, features, and details of the present invention can be more completely understood by reference to the following detailed description of preferred embodiments, taken in conjunction with the drawings and from the appended claims.

DETAILED DESCRIPTION OF THE INVENTION

Figure 1:
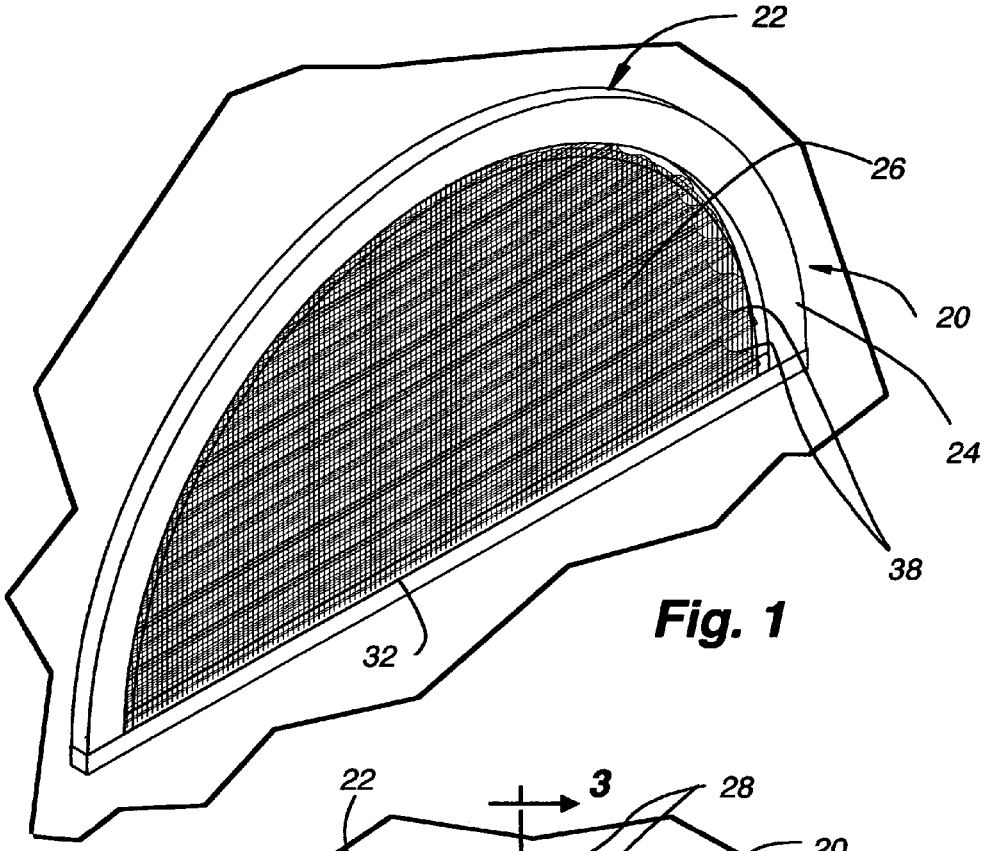
FIG. 1 is an isometric of a window opening having a semi-circular configuration with a covering suspended therein in accordance with the present invention.
Figure 2:
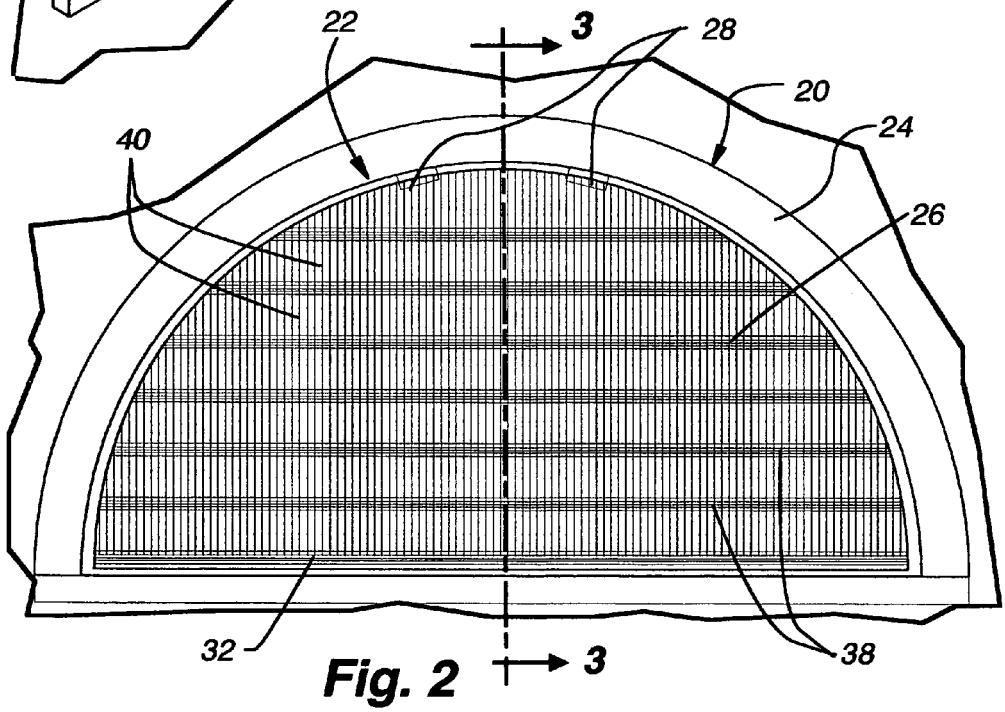
FIG. 2 is a front elevation of the window and covering of FIG. 1.

FIGS. 1 and 2 show an architectural opening 20 in the form of a window having a semi-circular configuration so that the window has a semi-circular or arcuate top edge 22. Conventional framework 24 extends around the window opening which is typically wood so as to form a support base for the system of the present invention. The system of the present invention includes a window shade material 26 that is suspended vertically in the architectural opening adjacent to a glass panel 27 through use of support brackets 28 anchored to the framework 24 along the upper edge of the architectural opening. In the embodiment of the present invention illustrated in FIGS. 1-7, a support channel 30 is also used to facilitate the attachment of the shade material to the support brackets. While the bottom edge 32 of the shade material 26 can be secured to the sill of the architectural opening, a weighted bottom rail 34 might also be included as shown best in FIG. 3 so as to retain the shade material, through gravity, in a desired fully-extended condition across the opening.

The shade material 26 could assume numerous forms. Modifications to the suspension system to be described hereafter in detail could be made accordingly. Such modifications are felt to be fully within the knowledge of those skilled in the art. For purposes of the present disclosure, the shade material is illustrated as a cellular shade material having a pair of vertically extending sheets 36 of material which are interconnected with a plurality of vertically spaced horizontally extending vanes 38 of generally S-shaped transverse cross-section.

Figure 3:
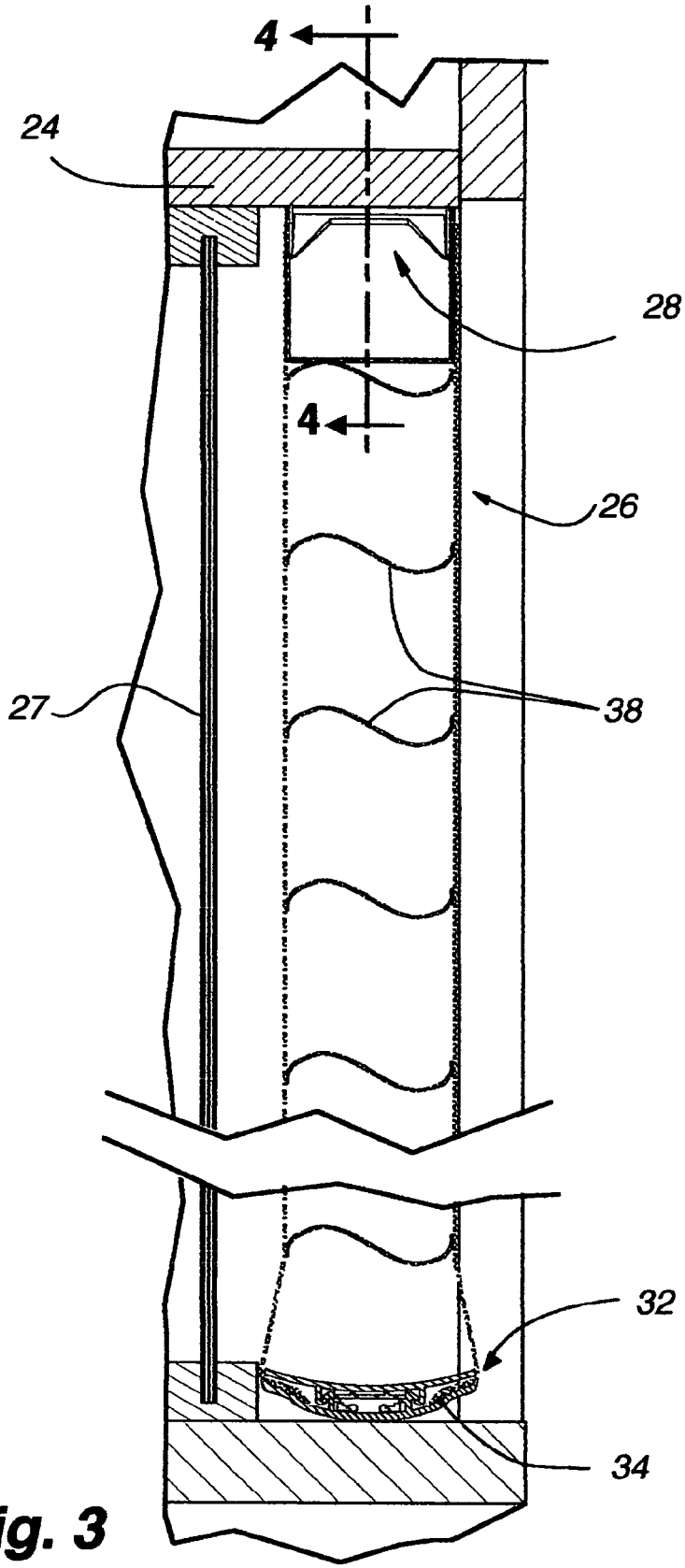
FIG. 3 is an enlarged fragmentary section taken along line 3-3 of FIG. 2.
Figure 4:
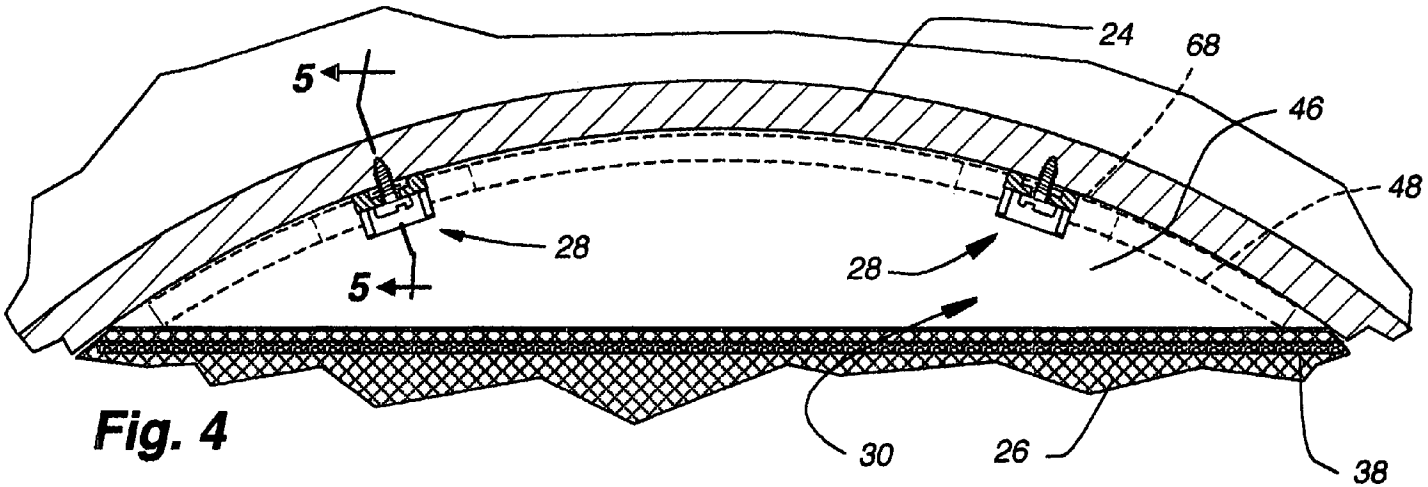
FIG. 4 is an enlarged fragmentary section taken along line 4-4 of FIG. 3.
Figure 4A:
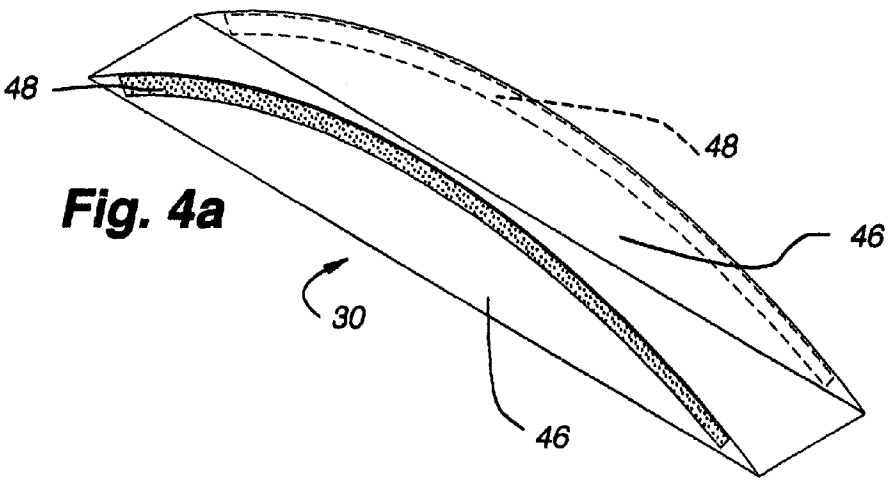
FIG. 4*a* is an isometric looking downwardly on the open top of a support channel used in the system of the present invention.

Such a shade material is known in the art and has been primarily designed to be retractable between the extended position shown in FIGS. 1-3 and a retracted position (not illustrated) wherein the shade material is wrapped around a roller in a headrail along the top edge of the shade material. The sheets 36, which are preferably sheer, are typically also movable with the roller so as to be shifted in opposite vertical directions thereby causing the vanes 38 to move between the open position illustrated in FIG. 3 and a closed position (not shown) wherein the vanes lie substantially in a flat vertical plane between the sheets of material. In the present invention, however, the shade material 26 merely remains suspended in the fully extended position with the vanes open as shown in FIG. 3 so as to define gaps 40 therebetween. With the system for suspending the shade material disclosed in the present invention, the shade material conforms to the shape of the architectural opening, for example, in the embodiment of FIGS. 1 and 2, a semi-circular configuration.

In order to suspend the shade material 26 in accordance with the present invention, the sheets 36 in the shade material are extended above the uppermost vane 38 and the top edges 42 of the sheets are cut to conform with the configuration of the framework 24 around the top of the architectural opening. In fact, the entire shade material is cut so that in its fully-extended position of FIGS. 1-3, the top edge of the shade material conforms with the top of the framework in the architectural opening.

The upwardly opening support channel 30 is positioned between the sheets 36 of the shade material and above the uppermost vane 38 in the shade material so that the sheets extend along arcuate side walls 46 of the support channel. The outer surfaces of the sidewalls along the arcuate upper edges thereof are provided with strips 48 of adhesive to which the sheets of the shade material are secured. In this manner, the sheets overlie the side walls of the support channel so that the sheets are continuous across the entire semi-circular architectural opening.

The support brackets 28 are utilized to suspend the support channel 30 and the shade material 26 from the framework 24 at the top of the architectural opening and any number of support brackets can be utilized typically dependent upon the size of the opening. In the disclosed embodiment, two such support brackets, which are identical, are utilized.

Figure 7:
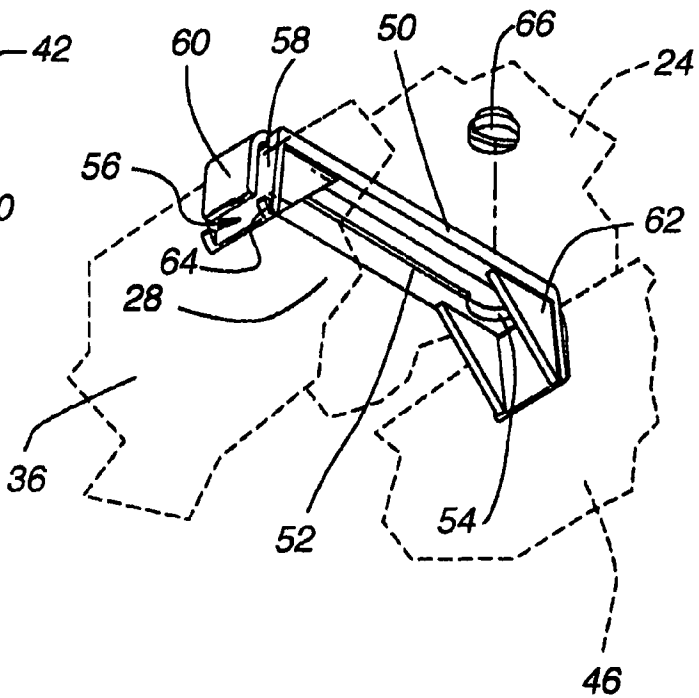
FIG. 7 is an isometric of the support bracket and its relationship to the shade material and framework for the architectural opening which are shown in dashed lines.

The support brackets 28 are seen best in FIGS. 4-7 wherein it will be appreciated each support bracket has a generally flat body 50 with an elongated slot 52 therein having an enlarged key hole 54 at one end to facilitate connecting the support bracket to the framework 24 of the architectural opening as will be described hereafter. At each end of the flat body 50 are downturned channels 56 formed from inner 58 and outer 60 spaced legs wherein the inner legs are interconnected by spaced gussets 62 to the flat body. A lower edge of each inner leg 58 has outwardly directed lips 64 that project into the space or channel 56 defined between the inner and outer legs. As best seen in FIG. 7, to mount the bracket to the framework around the architectural opening, a screw-type fastener 66 is inserted into the undersurface of the framework at a predetermined location and then the head of the fastener is inserted through the keyhole 54 in the slot 52 of the support bracket so that the bracket can be slid relative to the fastener to a desired location. The fastener can then be tightened to retain the support bracket at the desired location.

Figure 5:
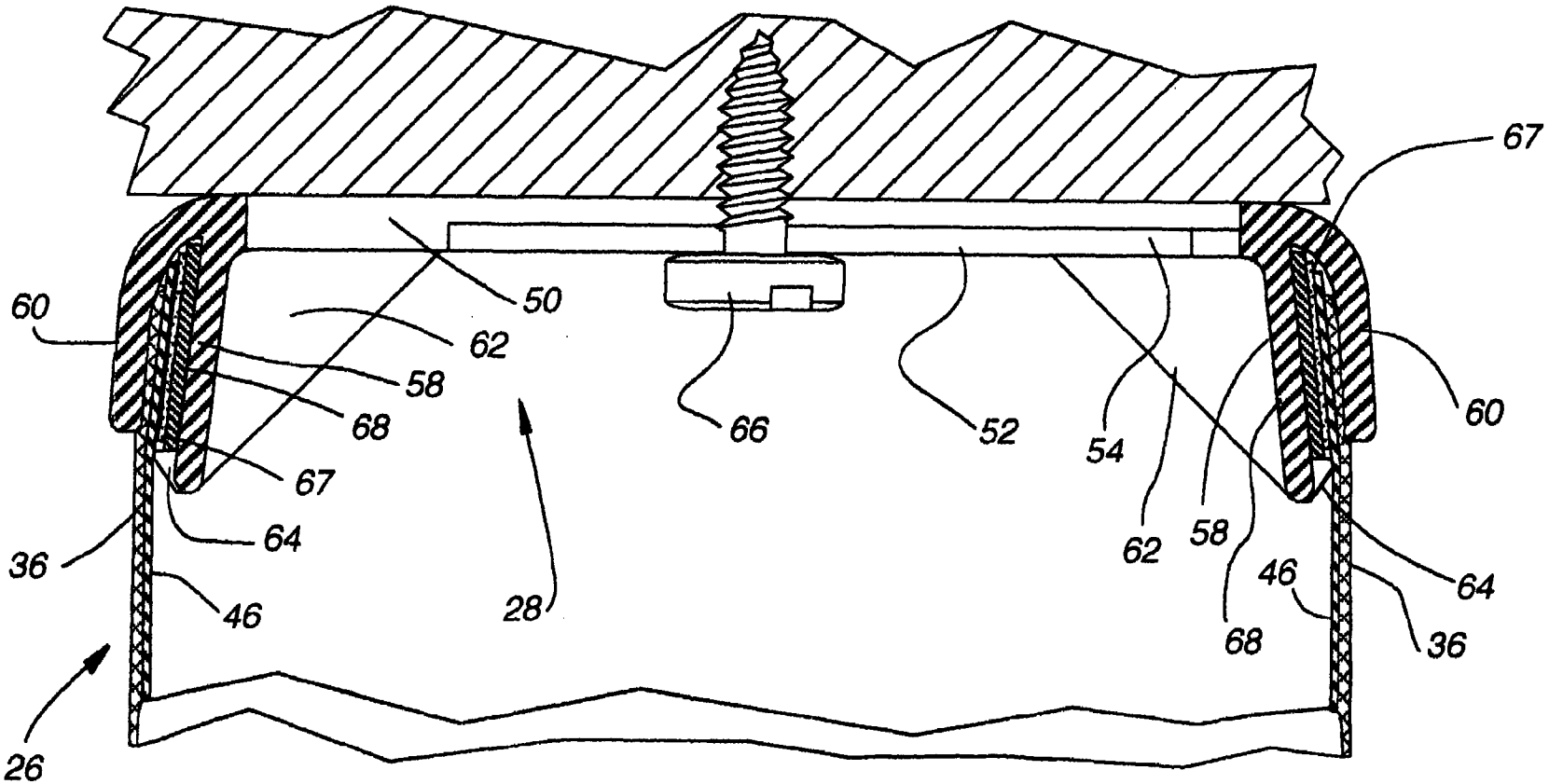
FIG. 5 is an enlarged fragmentary section taken along line 5-5 of FIG. 4.
Figure 6:
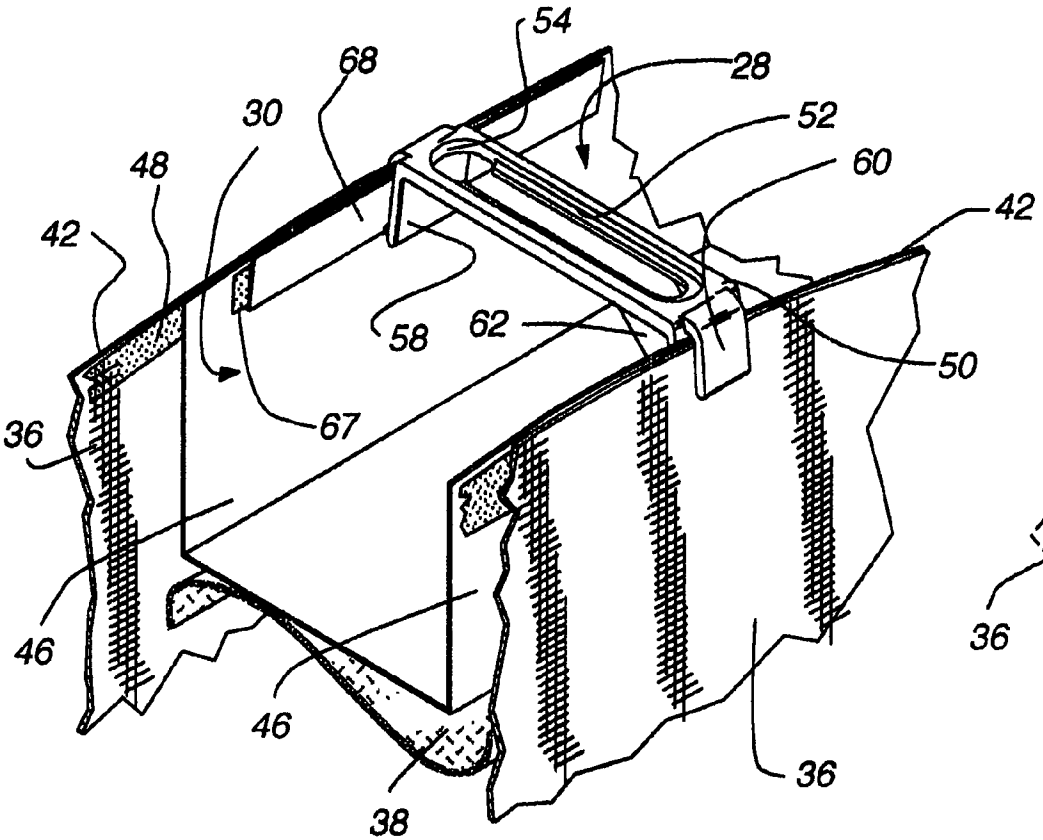
FIG. 6 is a fragmentary isometric showing a support bracket of the system of the present invention interconnected with the shade material and support channel.
Figure 8:
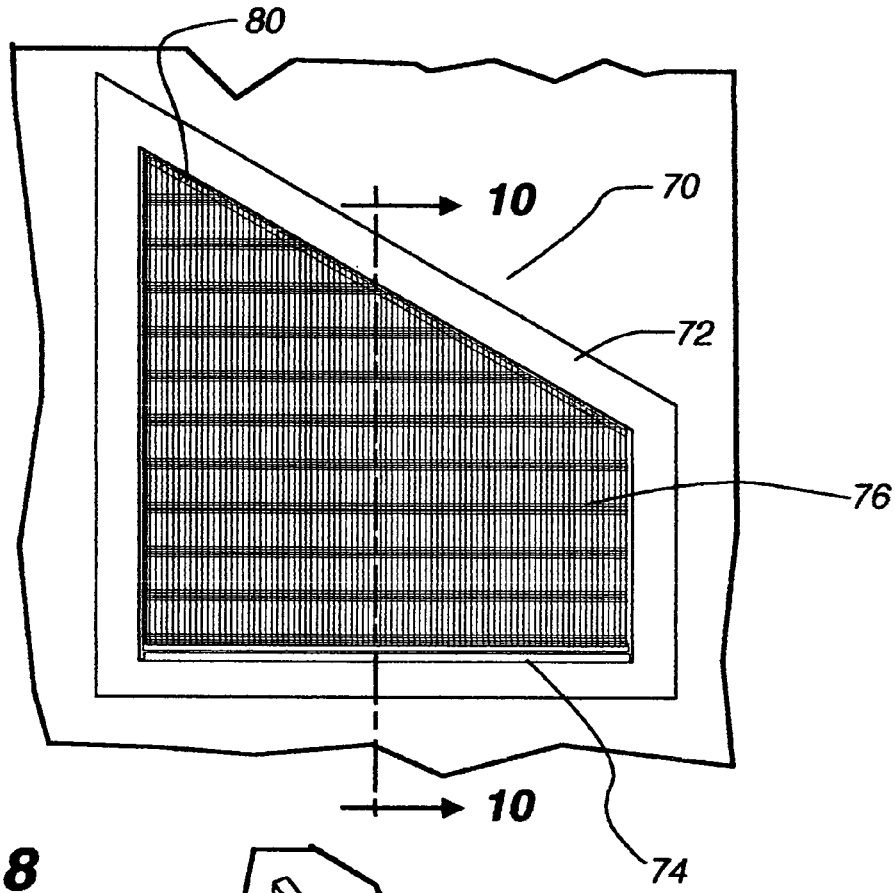
FIG. 8 is a front elevation of a window opening having a slanted or inclined top edge with a covering suspended therein in accordance with the present invention.
Figure 9:
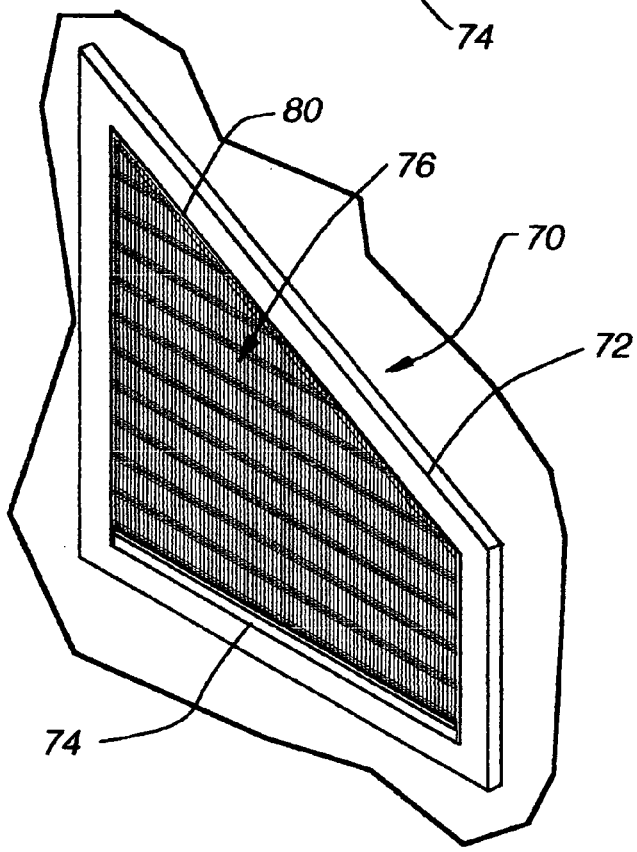
FIG. 9 is an isometric of the window as shown in FIG. 8.

As probably best seen in FIGS. 5 and 6, and as mentioned previously, the support bracket 28 is utilized to suspend the support channel 30 and the shade material 26 within the framework 24 of the architectural opening. The shade material is secured to the support channel as described previously so that the sheets 36 of shade material overlie the outer faces of the side walls 46 of the support channel.

Reinforcement strips 68 of plastic, rigidified fabric, metal or the like are secured with, for example, adhesive to the inner face of the side walls of the support channels along the top edges of the side walls with the reinforcement strips only being necessary at locations where a support bracket 28 will be interconnected with the support channel. While adhesive 67 is preferably used to connect the reinforcement strip with the support channel, it could be connected in any manner so long as the reinforcement strip establishes a slight laterally inward projection from the side walls of the support channel.

To interconnect the support channel 30 and shade material 26 to the support bracket 28, the top edges of the support channel are inserted into the downwardly opening channels 56 of the support bracket until the reinforcement strips are moved above the lips 64 on the inner legs 58 of the support brackets. The lips then underlie the lower edges of the reinforcement strips and the reinforcement strips with the support channel and shade materials connected thereto are retained on the lips by the outer leg 60 of the support bracket. Of course, to remove the support channel from the support bracket, the outer legs are flexed slightly so as to allow the reinforcement strips to be removed from their overlying relationship with the lips. Obviously, the support bracket is made of a material that is substantially rigid but has some flexibility and resiliency to permit attachment and removal of the support channel and shade material.

It has been found that once the top edge of the shade material 26 has been suspended from the top edge of the framework in the architectural opening with the support brackets 28 as described above and with the lower edge 32 of the shade material being either secured to the window sill or held by gravity in close relationship thereto with a weighted bottom rail 34, the upper edge of the shade material will lie in closely spaced or contiguous relationship with the framework around the top of the architectural opening so that the shade material custom fits the opening and will remain in the fully extended but open position illustrated and described.

A second embodiment of the present invention is illustrated in FIGS. 8-17*a* in an architectural opening 70 of generally rectangular configuration but wherein the top frame member 72 of the opening is at a bias or is inclined relative to the bottom edge or sill 74 of the opening. Again, the shade material 76 used in the system is shown as being identical to that of the previously described embodiment but the material is mounted in the opening with an alternative support bracket 78.

In this embodiment of the invention, the top edge 80 of the shade material 76 is cut along a bias or at an incline conforming to the incline of the top frame member of the architectural opening. Reinforcement strips 68 are secured as with adhesive 82 along the outer top edge of each of the sheets 84 of shade material 76 so the reinforcement strips project laterally outwardly away from the associated sheet of shade materials. The reinforcement strips are utilized to facilitate attachment of the shade material to any desired number of support brackets 78 mounted on the top frame member of the framework around the architectural opening.

The bracket 78 utilized in this embodiment is probably best illustrated in FIGS. 16, 16*a*, 17, and 17*a*. The bracket is a two-piece bracket having a mounting base 86 shown in FIGS. 17 and 17*a* and a main body 88 shown in FIGS. 16 and 16*a*. The mounting base has a passage 90 through one end thereof adapted to receive a screw-type fastener 92 that can be advanced into the top frame member of the framework around the architectural opening.

The mounting base 86 further includes a recess 94 in a top surface thereof to removably receive the main body 88 as will be described hereafter and a protruding lip 96 having a cam surface 98 at the end opposite the passage 90. The mounting base can be secured to the framework at any desired location and the main body releasably connected thereto as will be described hereafter.

The main body 88 has two identical components 100 defining slotted top walls 102 and downturned inner 104 and outer 106 legs at opposite ends of the top surfaces. The outer leg has an inturned lip 108 along its lower edge that protrudes into a space or channel area 110 defined between the inner and outer legs for a purpose to be described hereafter. Each component 100 is identical and connected to the other component with a bridge member 112 that is relatively thin and adapted to be slid into overlying relationship with the mounting base 86 when mounting the main body on the mounting base. The bridge member can be advanced against the cam surface 98 on the main body thereby allowing the bridge member to pass or slide over the protruding lip 96 on the mounting base until the bridge member is fully seated within the recess 94 in the mounting base. The main body can be removed from its seated relationship with the mounting base in a reverse manner.

Figure 10:
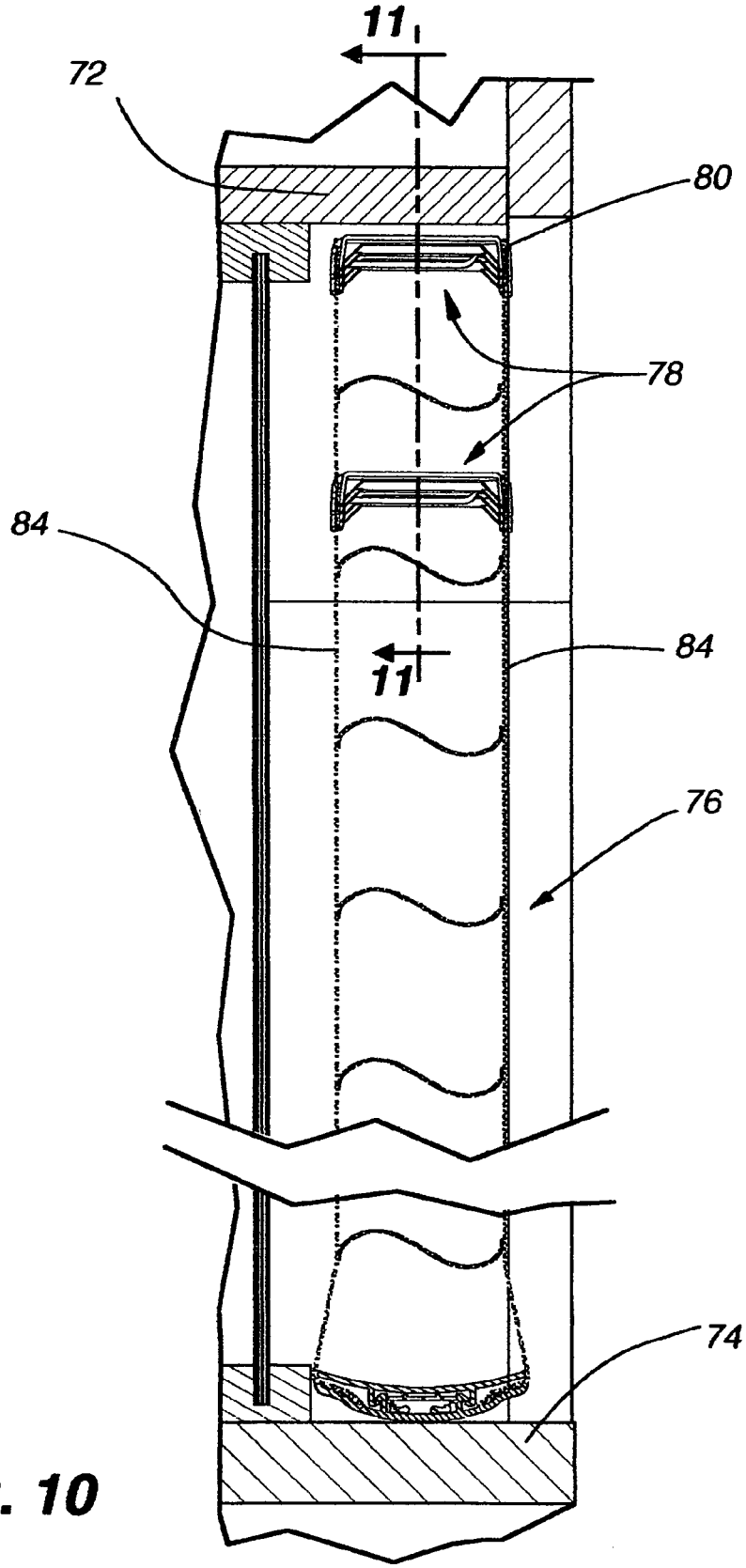
FIG. 10 is an enlarged fragmentary section taken along line 10-10 of FIG. 8.
Figure 11:
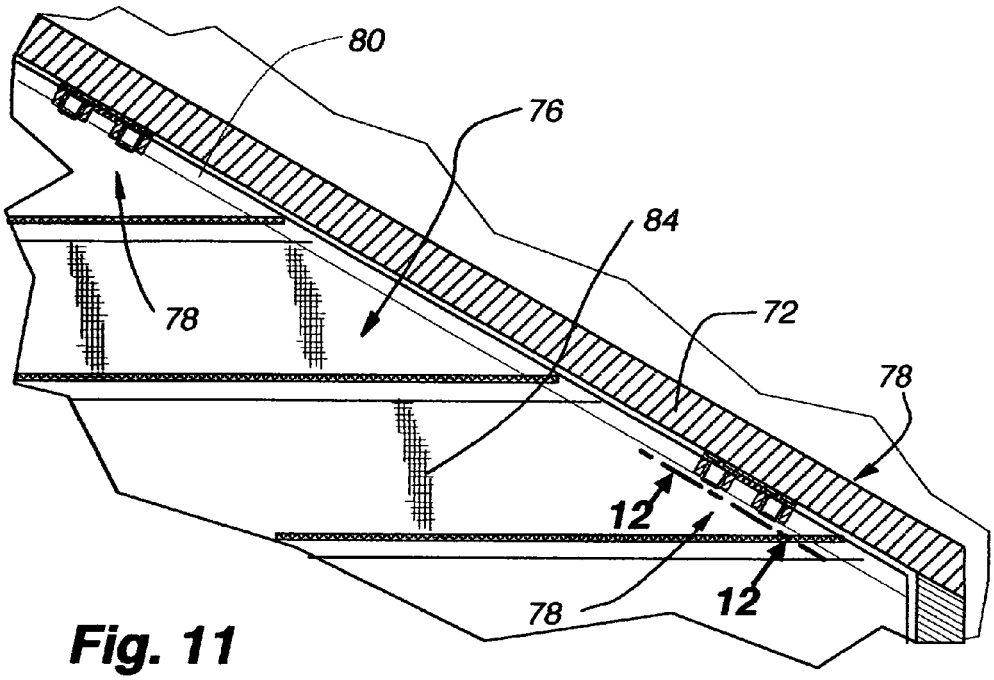
FIG. 11 is a fragmentary section taken along line 11-11 of FIG. 10.
Figure 12:
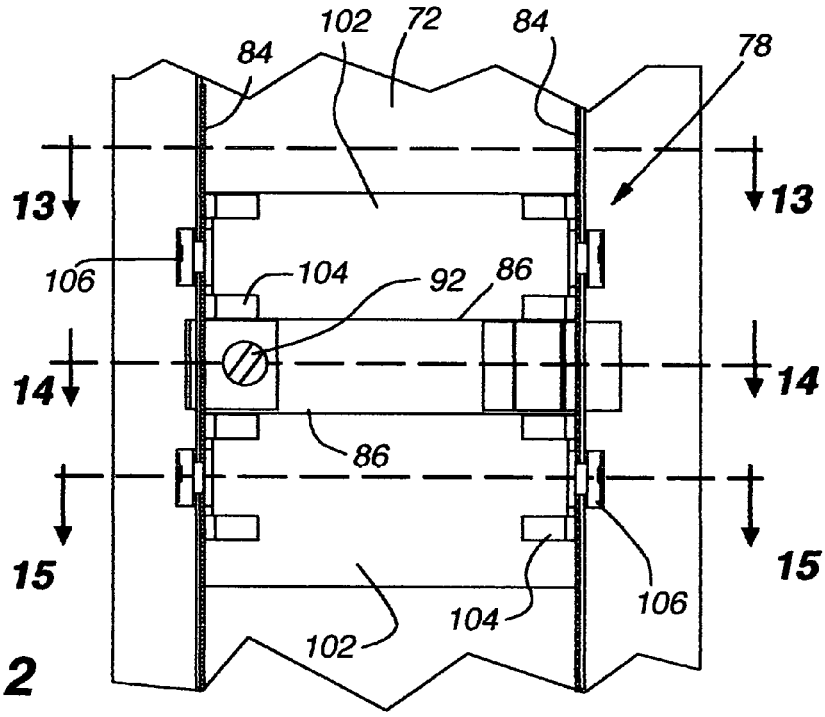
FIG. 12 is an enlarged fragmentary section taken along line 12-12 of FIG. 11.
Figure 13:
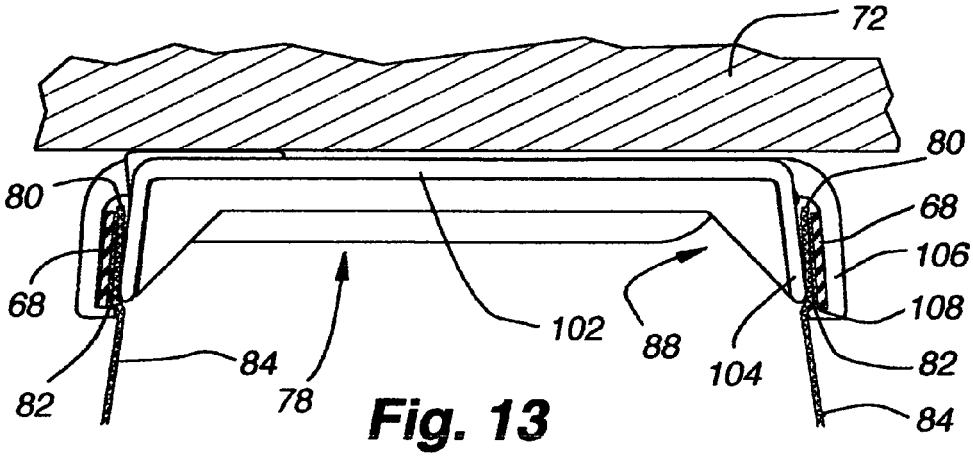
FIG. 13 is a fragmentary section taken along line 13-13 of FIG. 12.
Figure 14:
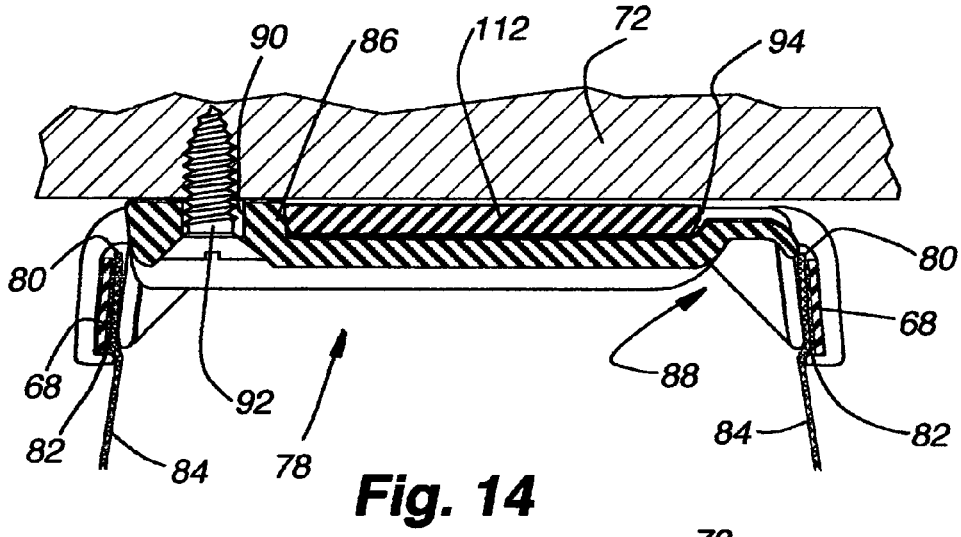
FIG. 14 is a fragmentary section taken along line 14-14 of FIG. 12.
Figure 15:
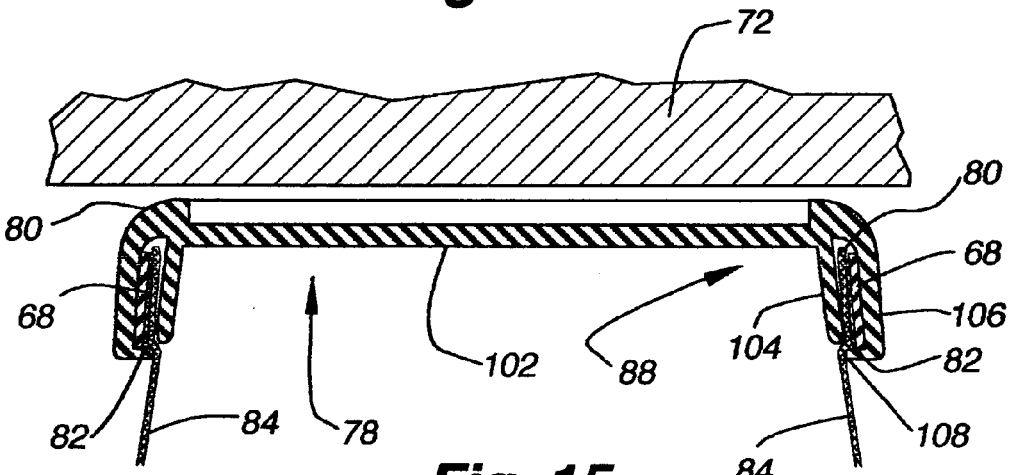
FIG. 15 is a fragmentary section taken along line 15-15 of FIG. 12.
Figure 16:
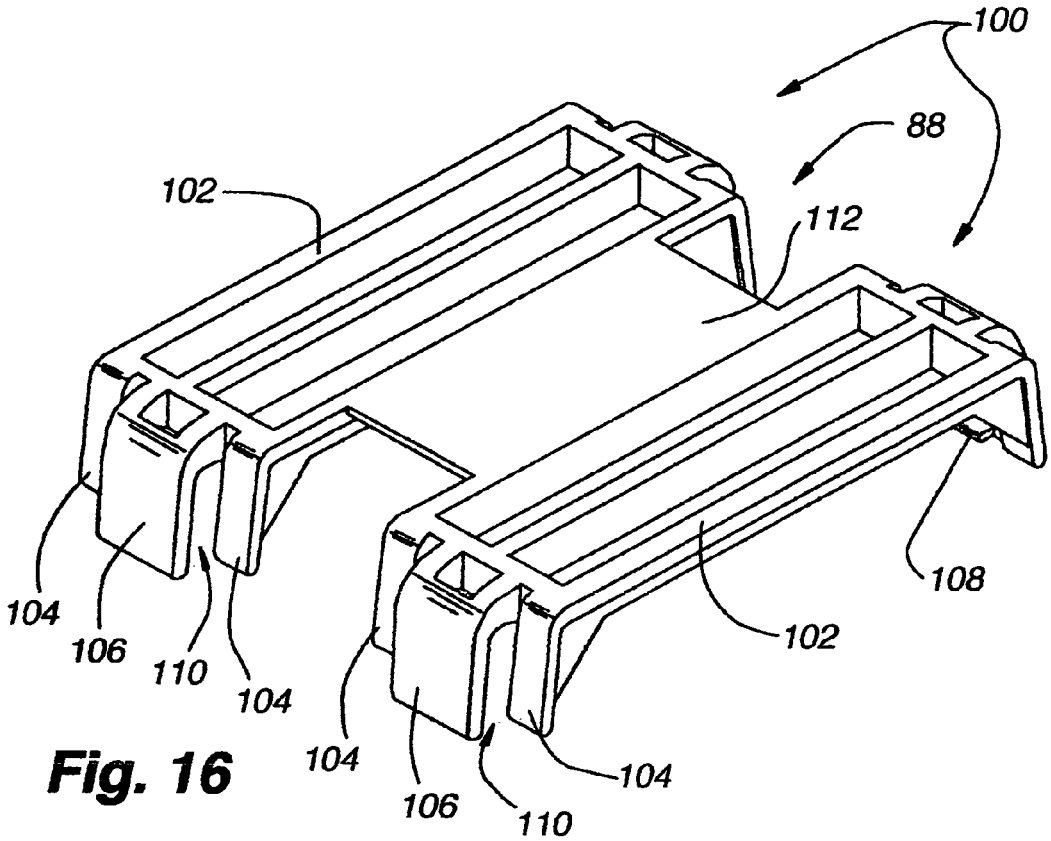
FIG. 16 is an isometric looking downwardly on the top of the main body portion of a second embodiment of a support bracket used in the system of the present invention.
Figure 17:
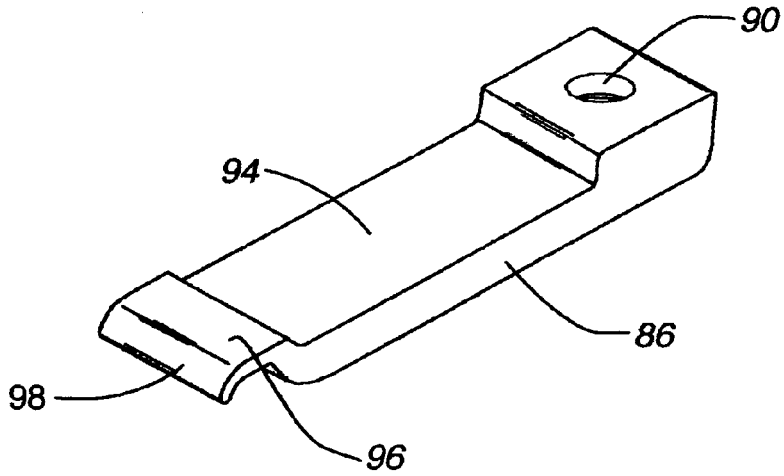
FIG. 17 is an isometric looking downwardly on the top of the base member component of the second embodiment of the support bracket of the present invention.
Figure 16A:
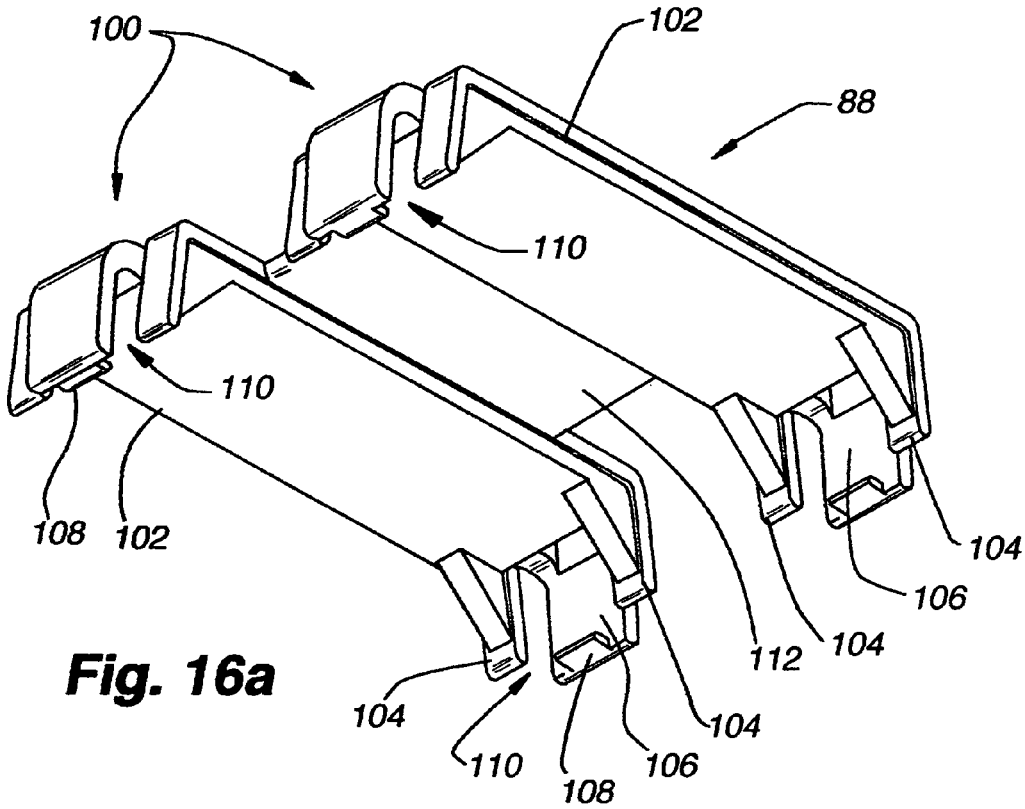
FIG. 16*a* is an isometric looking upwardly at the bracket component shown in FIG. 16.
Figure 17A:
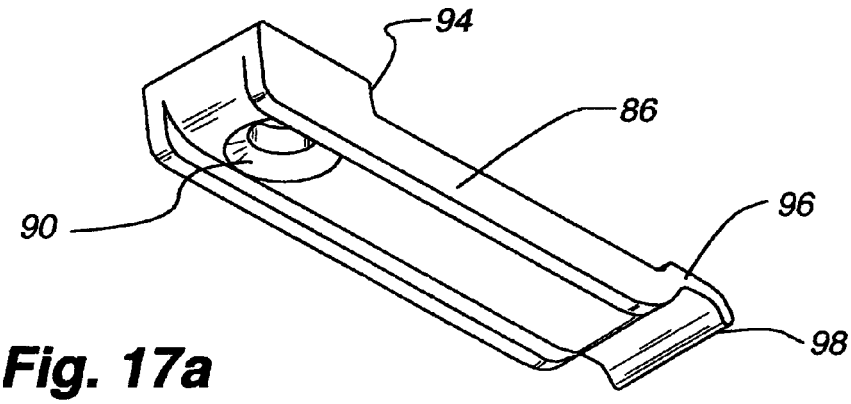
FIG. 17*a* is an isometric looking upwardly at the base component of the support bracket shown in FIG. 17.

The sheets 84 in the shade material 76 along their exposed upper edges to which the reinforcement strips 68 are connected can be inserted into the aligned downwardly opening channels 110 of the identical components 100 of the main body of the bracket so that the main body of the bracket retains the shade material with its sheets spaced as illustrated in FIG. 10. The lip 108 on the outer legs 106 of the main body of the mounting bracket support the reinforcement strips even though flexing of the outer legs allows the reinforcement strips with the sheets attached thereto to be removed from the main body of the mounting bracket if desired.

When suspending the shade material 76 within the architectural opening, the mounting base 86 of the support brackets 78 are first secured to the framework at desired spaced locations along the top frame member 72 and the shade material is secured to the main body 88 of the mounting bracket as described above. Finally the main body is slid over the mounting base 86 of the mounting bracket until the bridge member 112 lies within the recess 94 to releasably secure the main body to the mounting base.

As seen in FIG. 10, the shade material 76 is typically mounted on the interior side of a glass panel 112 or the like and within the framework of the architectural opening. The shade material hangs freely within the opening in a fully extended and open position. As with the first-described embodiment of the present invention, the bottom edge of the shade material could be secured to the sill of the architectural opening or connected to a weighted bottom rail 114 that retains the shade material in a fully extended position.

Although the present invention has been described with a certain degree of particularity, it is understood the disclosure has been made by way of example and changes in detail or structure may be made without departing from the spirit of the invention as defined in the appended claims.

What is claimed is:

1. A system for suspending a free-hanging covering in an architectural opening having a framework along at least an upper edge thereof, said system comprising in combination: a shade material adapted to be suspended vertically and having an upper edge, a laterally protruding reinforcement strip operatively secured to said edge, and a support bracket adapted to be secured to said framework along said upper edge of the architectural opening, said bracket having a downwardly opening channel and a lip projecting into said channel for supporting said reinforcement strip, said upper edge of said shade material and said reinforcing strip being confined in said channel.

2. The system of claim 1 wherein said shade material has a pair of upper edges spaced laterally from each other and further including a support channel member having laterally spaced upstanding side walls secured to said upper edges of said shade material.

3. The system of claim 2 wherein said reinforcement strip is secured directly to said side walls.

4. The system of claim 2 wherein said shade material further includes a bottom edge with a weighted rail secured thereto.

5. The system of claim 1 wherein said shade material has a pair of upper edges spaced laterally from each other with each upper edge having a reinforcement strip operatively secured thereto and wherein said support bracket has a pair of said downwardly opening channels in which said upper edges with reinforcement strips are confined.

6. The system of claim 5 wherein said support bracket has a support base securable to said framework and a releasably connected main body on which said pair of channels are disposed.

7. A system for suspending a free-hanging covering in an architectural opening having a framework along at least an upper edge thereof, said system comprising in combination:

a shade material adapted to be suspended vertically and having an upper edge with a lateral protruding reinforcement strip operatively secured thereto, a support bracket adapted to be secured to said framework along said upper edge of the architectural opening, said bracket having a lip for supporting said reinforcement strip, said support bracket having a downwardly opening channel into which said lip projects and into which said upper edge of said shade material and said reinforcement strip are combined, said shade material having a pair of upper edges spaced laterally from each other with each upper edge having a reinforcement strip operatively secured thereto and wherein said support bracket has a pair of downwardly opening channels in which said upper edges with reinforcement strips are confined, said support bracket having a support base securable to said framework and a releasably connected main body on which said pair of channels are disposed, and wherein there are two pair of said channels on said support bracket spaced from each other by a bridge component of the main body, said bridge component being releasably engaged with said base.

* * * * *